United States Patent [19]

Engelander

[11] 4,311,892

[45] Jan. 19, 1982

[54] PRESSURE LIMITING SWITCH FOR AN INSTRUMENT AIR CIRCUIT

[75] Inventor: Pieter Engelander, Veenendaal, Netherlands

[73] Assignee: Beta, B.V., The Hague, Netherlands

[21] Appl. No.: 129,036

[22] Filed: Mar. 10, 1980

[30] Foreign Application Priority Data

Apr. 11, 1979 [NL] Netherlands ..... 7902857

[51] Int. Cl.[3] ..... H01H 35/32

[52] U.S. Cl. ..... 200/81.4; 200/83 C; 200/83 S; 92/43

[58] Field of Search ..... 200/56 R, 308, 81 R, 200/81.4, 83 R, 83 C, 83 T, 83 Q, 83 S, 83 SA, 82 R, 82 C, 153 V; 92/34, 35, 37, 39, 40, 42, 43, 45; 73/717, 723, 729 X; 116/266, 268, 272

[56] References Cited

U.S. PATENT DOCUMENTS

| | | | |
|---|---|---|---|
| 2,440,034 | 4/1948 | Wiegers | 200/83 C |
| 2,475,069 | 7/1949 | Wood | 200/83 C |
| 2,950,421 | 8/1960 | Langstroth | 200/83 C |
| 4,054,763 | 10/1977 | Willcox | 200/83 R |
| 4,196,326 | 4/1980 | Vogler | 200/83 C |

*Primary Examiner*—Gerald P. Tolin

*Attorney, Agent, or Firm*—Charles H. Lindrooth

[57] ABSTRACT

A pressure limiting switch is provided for limiting the upper and lower limit values of the air pressure in a circuit feeding pneumatic controls. The switch has a switching arm which is pivotable at one end around a fixed axis in the switch body and adapted to actuate with its other end a microswitch closing a valve in the circuit if necessary. The air pressure is sensed by a movable element which engages the switching arm between the pivot axis and the microswitch. The switching arm is spring biased for compensating the microswitch spring. The air pressure range is adjustable through adjusting discs serving as abutments for movement of the switching arm.

7 Claims, 6 Drawing Figures

FIG. 4
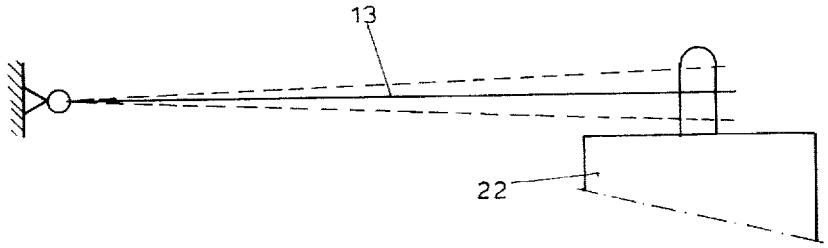
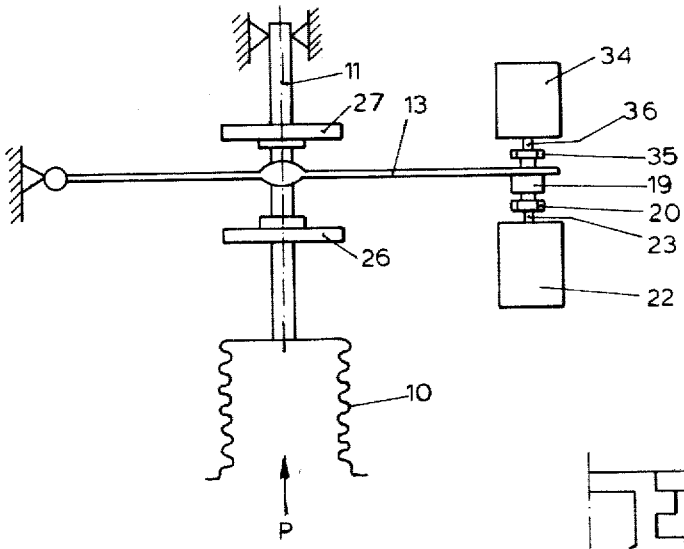
FIG. 5
FIG. 6
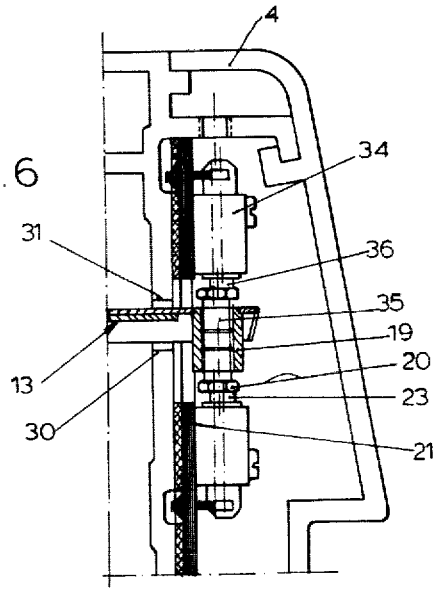

PRESSURE LIMITING SWITCH FOR AN INSTRUMENT AIR CIRCUIT

The invention relates to a pressure limiting switch comprising a body which receives at least one microswitch for actuating means for varying the pressure in an air circuit, said microswitch being actuatable by an element which is movable under the influence of the air pressure to be monitored, through a movable spring biased switching arm.

Pressure limiting switches of this type are known in which the switching arm constitutes a triangular plate which in two apexes engages a spring, while it is engaged in a third location by an actuating pin, adapted to actuate a microswitch. Said balance plate moves under the influence of a pressure sensor element which may engage the underside of the balance plate, along two axes against the force of said springs, whereby two independent switching points are formed.

The invention aims at designing said switch in a simpler construction and thereby cheaper, with a more dependable and more sensitive operation.

This is achieved by the invention in that the switching arm is connected at one end pivotable around a fixed axis in the body and is adapted to actuate with its other end the microswitch, while the element which is movable under the influence of the air pressure engages the switching arm between the pivot axis and the microswitch, the spring pressure acting on the arm end opposite to the microswitch.

The switching arm is fixed with its one end in the switch body so that a carefully determined displacement of the arm end actuating the microswitch occurs when the air pressure to be measured varies.

Preferably the switching arm carries at its actuating end an adjusting screw which is adjustable such that the switching arm in unloaded condition maintains the microswitch in a position between its switching points, an adjustable spring at the other side of this actuating end of the switching arm than the microswitch producing a spring pressure which compensates the switching spring pressure of the microswitch. Thereby the switch has very little mass inertia since with only a very small displacement of the switching arm by the movable element immediately the switching spring of the microswitch, which may click from the on position into the off position, is transferred to one of its both end positions.

The range within which the air pressure to be monitored must be kept by the switch is adjustable in that the pressure sensor element movable under the influence of the air pressure to be monitored acts on the switching arm via an actuating rod which freely extends through the arm and carries two adjustable abutments, as both sides of the arm. Both abutments together determine the lower and upper limit of the air pressure range.

An accurate adjustment is simply obtainable if the abutments are embodied as adjusting discs, comprising a central threaded bore, which is in engagement with screw thread on the actuating rod. In order to be able to accurately adjust the adjusting discs on the movable element and to maintain the adjusted positions, preferably a transparent sheetlike member of synthetic material having resilient ears is provided which laterally engages the adjusting discs as an arresting means and is provided with a calibration for adjusting the discs to the permissible limit pressures.

For some application of the pressure limiting switch according to the invention it is desirable that a signal, e.g. a light signal, is emitted when one of the limit pressures is exceeded, so that one may try to remove the trouble before the switch actuates an element, e.g. a valve, in the air circuit. However, if the pressure further changes in the same direction this means that the microswitch must be actuated.

This is obtainable in a different embodiment according to the invention in which the spring on the actuating end of the switching arm has been replaced by a second microswitch. Thereby, however, the spring force of the microswitch is not being compensated for.

The invention will hereunder be illustrated with reference to the drawing in which two embodiments as examples of the pressure limiting switch according to the invention are shown.

FIG. 4 schematically shows the mutual position of the switching arm.

FIG. 5 is a schematic illustration of an embodiment of the switch having two microswitches.

FIG. 6 shows the structural embodiment of the part with the switches of the embodiment according to FIG. 5.

Figure 1:
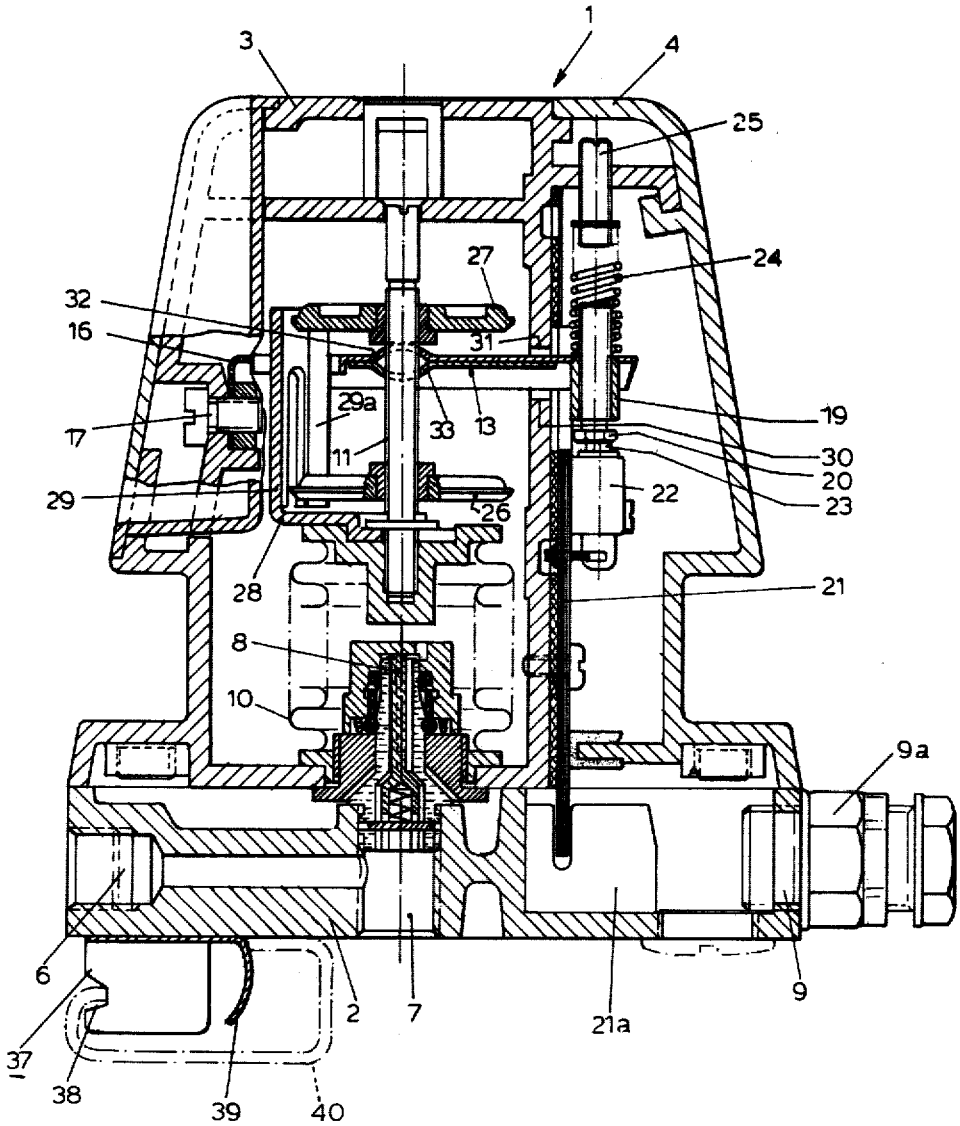
FIG. 1 is a section of the switch perpendicular to the switching arm.

The pressure limiting switch 1 as shown in FIG. 1 has a body comprising a base plate 2, on which two parts 3 and 4 respectively are fixed, each manufactured as an extrusion section and which may be slid and snapped together through projecting lips and recesses therefore, whereafter both parts 3, 4 may be fixed to the base plate 2. Both in the extrusion direction (the direction perpendicular to the plane of the drawing of FIG. 1) thereafter still open ends of the body are closed by flat end plates (not shown). The assembly may be manufactured from one or more suitable synthetic materials.

A bore has been provided in the base plate 2 which bore opens onto an outer surface of the base plate 2 via a counterbore 6, e.g. internally threaded, through which bore 6 a conduit (not shown) of an air circuit may be connected. The bore 5 opens at the other end into a bore 7, the axis of which is perpendicular to that of the bore 5, 6. In this bore 7 a valve 8 is mounted which is adapted to admit air of the bore 7 to the chamber of the body parts 3, 4. Also the conduit (not shown) of the air circuit may be connected to said bore 7. In that case the bore 6 is closed by a plug, or a pressure gauge (not shown) is connected therewith.

Figure 2:
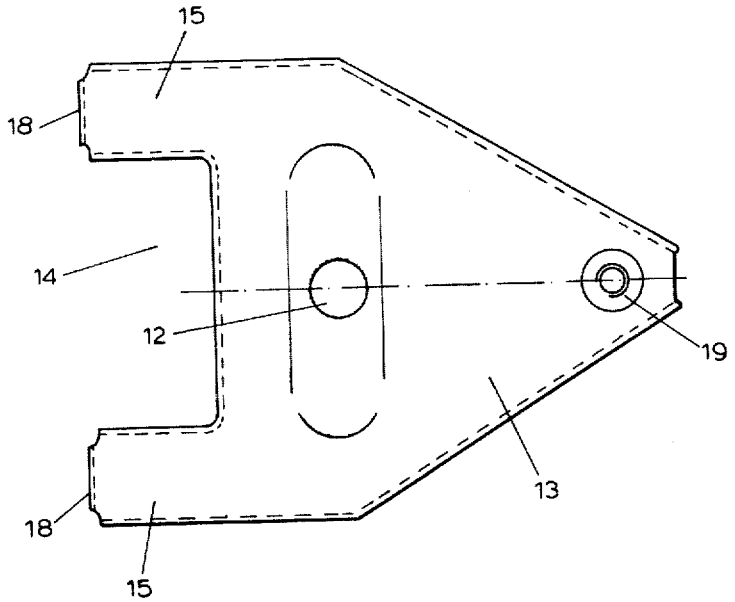
FIG. 2 is a plan view of the switching arm.

Around the valve 8 a bellows 10 is secured in an air tight manner in a body wall of the body part 3, 4, in which also the valve 8 has been mounted. A rod 11 is connected with the end of the bellows 10 which is opposite to the valve, which rod 11 constitutes together with the bellows the element which is movable under the influence of the air pressure to be monitored. Said rod 11 extends with clearance through an aperture 12 in a plate shaped switching arm 13 which is also shown in FIG. 2. The switching arm 13 has at one end, the left end in FIG. 1, a recess 14 whereby two legs 15 are formed on the switching arm, each extending into a part 16 which is bent away from the plane of the arm. Said parts 16 are each secured through a fastener 17 in the body part 3. At the location of the bending place material has been removed from the plate so that weakened cross-sections 18 have come into existence which constitute, through the resiliency of the material of the arm, the pivot points for movement of the arm. The arm is preferably manufactured from a metal.

The other end of the switching arm 13 carries in the axis of this arm a threaded sleeve 19 into which an adjusting screw 20 has been threaded. A printed circuit board 21 is provided against a body wall, on which board electrical conductors are provided which are connected through a special connector 21*a* via a communication bore 9 in the body and e.g. a cable nipple 9*a* with electrical conductors (not shown) for actuating valves, instruments or other means. Also a microswitch 22 is secured to the bore 21, the switching knob 23 of which is situated opposite to the head of the adjusting screw 20. The adjusting screw 20 projects at the upper side of the switching arm 13 beyond said arm and beyond the sleeve 19 and there serves for guiding a spring 24 which with one end engages the switching arm and with the other end a spring adjustment screw 25 which is threaded in a suitable bore of the body.

The rod 11, connected to the bellows 10, which together constitute the movable switch element, is externally threaded which engages two adjusting discs 26 and 27 respectively, the adjusting disc 26 being below the switching arm 13 and the adjusting disc 27 above the switching arm. Said adjusting discs serve, as will be explained below, for determining the limits of the range within which the air pressure of the air circuit, which is to be monitored, may find itself.

At the point of connection between the bellows 10 and the rod 11 an arresting means 28 has been provided. Said means has a projecting portion 29 which is substantially in the form of a sheet on which is indicated a calibration for the pressure. This sheetlike portion 29 has two resilient ears 29*a* at both sides of the portion 29, said ears extending beside the adjusting discs 26, 27, substantially parallel to the rod 11. The means 28 is preferably manufactured from a transparent synthetic material and resiliently engages with its ears 29*a* the lateral edges of the adjusting discs. The adjusting discs are at their circumference knurled or serrated, which is not shown, which circumference engages the end of the sheet 29 which is closest to the rod 11 and which end is resiliently pressed against the knurled or serrated circumference, so that the adjusted position of the discs 26, 27 is thereby arrested. The portion 29 of the means 28 is opposite to an aperture or window in the body 3, 4 of the switch, whereby the calibration indicated on the portion 29 may be read. Thereby the pressures, for which the adjusting discs have been adjusted, are visible from outside the switch. The pressure limiting switch 1 as shown operates as follows. When the switch is connected to an air circuit the air is admitted through the valve 8 to the interior of the bellows 10. When this pressure is within the permitted pressure range, the switching arm 13 is in its neutral, in FIG. 1 horizontal position and both adjusting discs 26, 27 are free from the switching arm. The spring 24 is adjusted such, through the screw 25, that the force which this spring imparts to the end of the switching arm 13, compensates the force which is imparted by the switching spring of the microswitch 22 to this arm end. The screw 20 is adjusted such that in the neutral position of the arm 13 this screw keeps the switching knob 23 of the microswitch moved to the position between both end positions of the switching spring (FIG. 4). Thereby the microswitch will be switched as soon as the rod 11 establishes via one of the adjusting discs 26, 27 an even very small displacement of the switching arm. The pressure limiting switch therefore is very sensitive in its reactions.

The pressure range which usually is permissible for so-called instrument air, e.g. for pneumatic controls, usually extends from 3 to 15 psi, that is from 20.6 to 103.4 kPa. The adjusting disc 26 is then adjusted to the upper pressure valve and the adjusting disc 26 to the lower pressure valve.

When in the position as shown in FIG. 1 the pressure decreases, the disc 27 takes along the switching arm downwardly whereby this effects the switching of the microswitch 23, whereby e.g. a valve (not shown) in the air circuit and leading to instruments is closed. If the pressure further decreases, the switching arm engages an abutment 30 in the body and thereafter the arm is not further lowered. If the pressure increases to a higher value than the upper limit value, the adjusting disc takes along the switching arm upwardly whereby from the neutral position of the switching arm likewise the switching of the microswitch is effected. If the pressure still further increases, also here the switching arm engages an abutment 31 in the body.

In the embodiment shown the switching arm is provided around the aperture 12 with an embossment or cam 32 or 33 at the upper side and the lower side of the arm respectively. This enables a good local contact with the adjusting discs.

FIG. 6 shows a detail of the switch according to FIG. 1, however in a different embodiment, in which two microswitches 22 and 34 respectively have been provided at both sides of the actuating end of the switching arm 13. As said, the meaning thereof may be to provide for the possibility that when the pressure is exceeded the pressure limiting switch first issues a signal and only if the pressure changes further in the same direction, the pressure is removed through the other microswitch. With respect to the embodiment of FIG. 1, in this case the adjusting screw 20 ends below the switching arm within the sleeve 19 and a second adjusting screw 35 has been threaded into the upper end of the sleeve 19, the head of that screw being situated opposite to the switching knob 36 of the microswitch 34. The switching spring pressure of the microswitches in this case cannot be compensated for by an additional spring, such as the spring 24 according to FIG. 1. For the rest this embodiment operates substantially in the same manner as that according to FIG. 1. If the pressure increases and also if it decreases outside the limits of the pressure range, switching of first one microswitch and thereafter the other microswitch is effected.

To the underside of the base plate 2 of the switch 1 has ears 37, provided with a recess 38, as well as a spring 39 are secured, which parts serve for permitting the easy mounting of the switch to a mounting rail 40 and if necessary also the easy removal from the rail.

Figure 3:
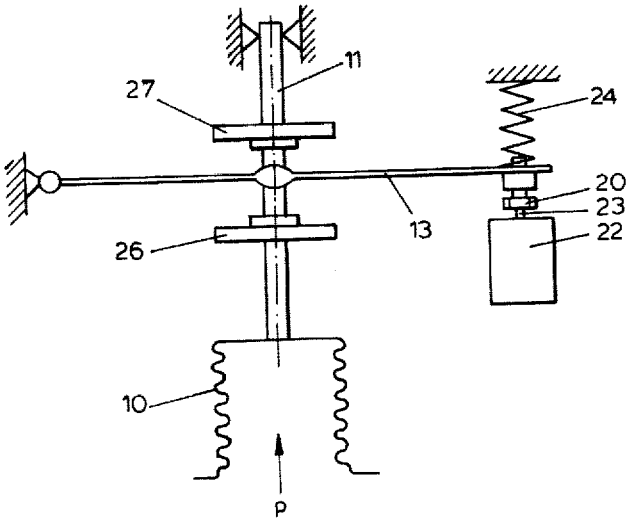
FIG. 3 shows schematically the switch of FIG. 1 in the embodiment having a single microswitch.

FIG. 3 shows schematically the switch in the embodiment of FIG. 1, and FIG. 5 shows the switch in the embodiment according to FIG. 6.

I claim:

1. Fluid pressure limiting switching means including a microswitch and comprising a switching arm, means pivotally mounting one end of said switching arm for movement about a fixed point with the opposite end of said arm being in position to actuate the microswitch, an actuating rod axially moveable under the influence of fluid pressure to be monitored for moving said switching arm about said fixed pivot point, an opening in the arm through which said rod extends, said rod being moveable with respect to the arm, said opening providing clearance between the rod and the arm so that the rod and arm do not contact each other throughout all positions of the rod, a pair of abutments located on said rod on opposite sides of said arm, said abutments being adjustable axially of the rod and being movable with the rod into positions of contact with the arm for pivotal movement of the arm toward and away from microswitch actuating position.

2. Pressure limiting switch means according to claim 1 wherein said pivotal mounting means includes means biasing said switching arm to an intermediate position when the switching arm is not loaded by one of said abutments.

3. Pressure limiting switch means according to claim 2, further including an adjusting screw on the actuating end of said switching arm, said adjusting screw being settable to maintain said microswitch in a neutral position when the switching arm is in said intermediate position, and an adjustable spring acting on the actuating end of said switching arm, said spring acting on the side of said arm opposite to the microswitch with a biasing pressure selected to compensate for the spring pressure of the microswitch.

4. A switch according to claim 2 further including a second microswitch positioned adjacent the switch actuating end of said switching arm on the side of said arm opposite to said first named microswitch, said switch actuating arm being moved between a position of actuation of said first microswitch and a second position of actuation of said second named microswitch.

5. Pressure limiting switch means according to claim 3, characterized in that the abutments comprise adjusting discs, each being provided with a central threaded bore and threads on the actuating rod in engagement with the threads in said threaded bores.

6. Switch means according to claim 5, further comprising a transparent sheetlike part of synthetic material, said part having at least one resilient ear laterally engaging the adjusting discs and acting as an arresting means whereby the discs may be calibrated by adjusting the discs to the permissable limit pressures.

7. A switch according to claim 3 characterized in that the switching arm at the position of the pivot axis has, in view of the pivotability, a smaller cross-section than in its remaining parts.

* * * * *